US010143615B2

(12) United States Patent
Pardoel et al.

(10) Patent No.: US 10,143,615 B2
(45) Date of Patent: Dec. 4, 2018

(54) DEVICE FOR TREATING SKIN

(71) Applicant: KONINKLIJKE PHILIPS N.V., Eindhoven (NL)

(72) Inventors: Michel Gerardus Pardoel, Eindhoven (NL); Anthony James Skeats, Eindhoven (NL); Arjun Caprihan, Eindhoven (NL); Rob Mark, Eindhoven (NL); Chin Eng Yeap, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 982 days.

(21) Appl. No.: 14/413,031

(22) PCT Filed: Jun. 28, 2013

(86) PCT No.: PCT/EP2013/063659
§ 371 (c)(1),
(2) Date: Jan. 6, 2015

(87) PCT Pub. No.: WO2014/009177
PCT Pub. Date: Jan. 16, 2014

(65) Prior Publication Data

US 2015/0202114 A1 Jul. 23, 2015

(30) Foreign Application Priority Data

Jul. 10, 2012 (EP) ..... 12175730

(51) Int. Cl.
*A61H 23/00* (2006.01)
*A61H 23/02* (2006.01)
*A61H 7/00* (2006.01)

(52) U.S. Cl.
CPC ..... *A61H 7/005* (2013.01); *A61H 23/0218* (2013.01); *A61H 2023/0209* (2013.01);
(Continued)

(58) Field of Classification Search
CPC ..... A61H 23/00; A61H 23/02; A61H 23/006; A61H 23/0218; A61H 23/0254;
(Continued)

(56) References Cited

U.S. PATENT DOCUMENTS 2,234,102 A * 3/1941 Andres ..... A61H 9/005 601/101
2,378,335 A * 6/1945 Snyder ..... A61H 23/0218 601/79
(Continued)

FOREIGN PATENT DOCUMENTS

CN 2282869 Y 6/1998
DE 19505047 C 1/1997
(Continued)

*Primary Examiner* — Michael Tsai
*Assistant Examiner* — Christopher Miller

(57) ABSTRACT

The present application relates to a device for treating skin (1) comprising a housing (2), a shaft (14) located in the housing (2) having a longitudinal axis ('A') and an end for receiving a skin treating part (3). The device (1) further comprises a drive means configured to cause the shaft to rotate about its longitudinal axis, and to oscillate in a direction along the longitudinal axis, wherein the drive means comprise a rotational drive unit for rotating the shaft (14) and an oscillation generator (26) for oscillating the shaft. The oscillation generator (26) is located about the shaft (14) such that the shaft is rotatable relative to the oscillation generator. Furthermore, the oscillation generator (26) comprises a solenoid (39) and a flux assembly (25), and the flux assembly (25) is moveable along the shaft (14) relative to the solenoid (39).

13 Claims, 3 Drawing Sheets

(52) U.S. Cl.
CPC ..... *A61H 2201/0153* (2013.01); *A61H 2201/0157* (2013.01); *A61H 2201/0169* (2013.01); *A61H 2201/123* (2013.01); *A61H 2201/1215* (2013.01); *A61H 2201/1463* (2013.01); *A61H 2201/1664* (2013.01); *A61H 2201/1671* (2013.01); *A61H 2201/1685* (2013.01); *A61H 2201/5007* (2013.01); *A61H 2201/5035* (2013.01)

(58) Field of Classification Search
CPC ..... A61H 1/005; A61H 1/008; A46B 13/02; A46B 13/008; A46B 2200/102; A46B 2200/1006
See application file for complete search history.

(56) References Cited

U.S. PATENT DOCUMENTS 3,096,758 A * 7/1963 Savage ..... A61H 23/0218 164/DIG. 5
3,512,201 A 5/1970 Taylor
3,980,908 A * 9/1976 McClintock ..... G03B 7/083 264/101
4,512,339 A * 4/1985 McShirley ..... A61H 23/0218 310/23
4,549,535 A * 10/1985 Wing ..... A61H 23/0218 310/35
4,827,914 A * 5/1989 Kamazawa ..... A61H 23/0254 601/101
4,841,955 A * 6/1989 Evans ..... A61H 23/0218 601/101
5,140,979 A * 8/1992 Nakagawa ..... A61H 23/0218 128/907
5,208,933 A 5/1993 Lustig
5,361,437 A * 11/1994 Zhu ..... A61H 23/0218 5/639
5,423,102 A 6/1995 Madison
5,593,381 A * 1/1997 Tannenbaum ..... A61H 23/0218 601/101
6,277,085 B1 * 8/2001 Flynn ..... A61H 23/0218 601/78
6,722,232 B1 * 4/2004 Day ..... B25B 13/467 81/56
6,994,679 B1 * 2/2006 Lee ..... A61H 23/0218 601/15
7,282,037 B2 * 10/2007 Cho ..... A61H 23/0218 601/15
8,641,648 B2 2/2014 Colloca
2002/0156402 A1 * 10/2002 Woog ..... A61H 23/0236 601/46
2003/0195443 A1 * 10/2003 Miller ..... A61H 1/008 601/108
2006/0098376 A1 * 5/2006 Satoh ..... H01H 47/325 361/152
2006/0122631 A1 6/2006 Kertz
2006/0149169 A1 * 7/2006 Nunomura ..... A61B 8/546 601/2
2006/0272666 A1 * 12/2006 Wyatt ..... A46B 9/021 132/218
2006/0272667 A1 * 12/2006 Wyatt ..... A45D 40/265 132/218
2007/0112357 A1 5/2007 Skinner
2007/0220689 A1 9/2007 Choi
2007/0249974 A1 * 10/2007 Kim ..... A61H 1/005 601/48
2008/0036303 A1 * 2/2008 Stevens ..... A61H 1/005 310/12.04
2009/0043231 A1 * 2/2009 Murugan ..... A61H 1/008 601/101
2011/0084097 A1 4/2011 Gueret
2011/0118638 A1 * 5/2011 Yoo ..... A61H 7/005 601/108
2011/0166486 A1 * 7/2011 Kumanomido .... A61H 23/0236 601/15
2012/0253244 A1 * 10/2012 Femano ..... A61H 7/004 601/84
2015/0202114 A1 7/2015 Pardoel

FOREIGN PATENT DOCUMENTS

JP 2009207537 A 9/2009
JP 2010075264 A 4/2010
WO 03096860 A1 11/2003
WO 2008129441 A1 10/2008

* cited by examiner

DEVICE FOR TREATING SKIN

This application is the U.S. National Phase application under 35 U.S.C. § 371 of International Application No. PCT/EP2013/063659, filed on Jun. 28, 2013, which claims the benefit of International Application No. 12175730.6 filed on Jul. 10, 2012. These applications are hereby incorporated by reference herein.

FIELD OF THE INVENTION

The present invention relates to a device for treating skin in terms of cleaning, exfoliating and massaging the skin of a user.

BACKGROUND OF THE INVENTION

It is known to provide devices for cleaning, exfoliating and massaging skin. These devices comprise a brush, or other type of skin treating part, that is configured to rotate. In use, the rotating brush is placed against the skin and the rotating movement stimulates microcirculation, removes dirt and dead skin cells thereby leaving the skin of the user feeling smooth and clean.

It is also known to provide a device for treating skin wherein the brush is configured to vibrate in addition to rotate which enhances the sensation of a clean and treated skin. However, the speed of the rotating movement and the frequency of the vibrating movement cannot be independently changed by the user and so a user cannot adjust the device to their personal preference.

SUMMARY OF THE INVENTION

It is an object of the invention to provide a device for treating skin which substantially alleviates or overcomes the problems mentioned above.

According to the present invention, there is provided a device for treating skin comprising a housing, a shaft located in the housing having a longitudinal axis and an end for receiving a skin treating part, and a drive means configured to cause the shaft to rotate about its longitudinal axis, and to oscillate in a direction along the longitudinal axis, wherein the drive means comprise a rotational drive unit for rotating the shaft and an oscillation generator for oscillating the shaft, the oscillation generator is located about the shaft such that the shaft is rotatable relative to the oscillation generator, the oscillation generator comprises a solenoid and a flux assembly, and the flux assembly is moveable along the shaft relative to the solenoid.

This arrangement provides the advantage that in use, when a skin treating part is attached to the end of the shaft, the skin treating part moves substantially perpendicular to the skin which improves the cleaning and the massaging effect on the skin. Furthermore, the oscillation generator is not coupled to the rotational drive unit and so the oscillating movement can be controlled independently to the rotation of the shaft.

Preferably, the rotational drive unit and the oscillating generator are configured such that the speed of the rotation and the frequency of the oscillation of the shaft can be independently changed of one another in response to a user input.

Advantageously, the user can therefore adjust the frequency and the speed of rotation to their personal preference.

Preferably, the flux assembly comprises an inner and an outer flux concentrator and a magnet located therebetween.

The arrangement of the flux assembly concentrates the magnetic forces emitted by the magnet.

In one embodiment, the outer flux concentrator is made of a base panel having a peripheral side panel, and the inner flux concentrator is received within the peripheral side panel, the magnet is located between the inner flux concentrator and the base panel, and a gap is formed between the inner flux concentrator and the peripheral side panel for receiving the solenoid.

Conveniently, the device further comprises first and second supports holding the shaft, the flux assembly being located about the shaft between the first and second supports and the solenoid being attached to one of the supports.

Advantageously, the flux assembly is retained between the first and second supports such that it cannot accidentally fall off the shaft.

Conveniently, the shaft is held by the first and second supports such that the shaft is rotatable relative to the supports about the longitudinal axis but prevented from moving along the longitudinal axis relative to at least one of the supports.

This arrangement enables the axial movement of the flux assembly to be transferred to the shaft as the flux assembly impacts at least one of the supports The shaft may comprise a circumferential groove in which the one of the supports locate so as to prevent the shaft from moving along the longitudinal axis relative to the support which located in the groove.

Advantageously, as the flux assembly impacts the support located in the groove, the support is moved in an axial direction and transfers the axial movement to the shaft.

One of the supports may be formed with an e-clip that locates in the circumferential groove.

This provides the advantage that the axial movement of the flux assembly is transferred to the support formed with an e-clip and as the e-clip locates in the groove the axial movement is transferred to the shaft.

Preferably, one of the supports is formed with a stop which the flux assembly impacts as it oscillates.

As the stop takes the impact of the flux assembly, wear of the support formed with the stop is advantageously reduced.

In one embodiment, a spring is located between the first or the second support and the flux assembly so as to reduce the impact as the flux assembly oscillates.

This arrangement advantageously reduces audible noise produced as the flux assembly impacts the first or second support.

The device further comprises a power source powering the drive means.

Advantageously, this arrangement enables a single power source to power the drive means reducing size and weight of the device.

In one embodiment, the device further comprises an inverter for changing the current supplied by the power source to alternating current.

This causes the polarity of the solenoid to change so that it alternates between being attracted and repelled to the magnet.

Conveniently, the device may comprise a frequency converter for changing the frequency of the alternating current.

Advantageously, the frequency converter is configured to change the frequency in response to a user input such that the strength of the oscillating movement of the shaft and so the brush can be changed to the personal preference of a user.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
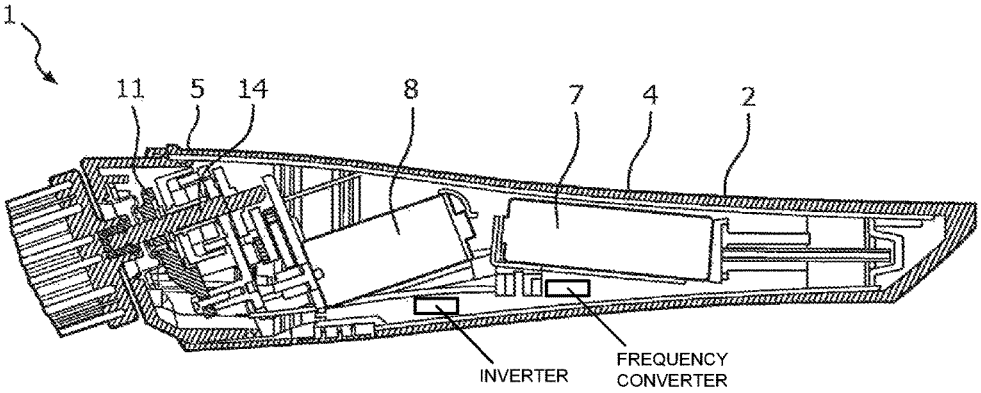
FIG. 1 shows a side view of an embodiment of a device for treating skin wherein a housing of the device is partially omitted.

Referring now to the drawings, a device 1 for treating skin is shown in FIG. 1. The device 1 comprises a housing 2 having a first handheld region 4 which is suitable for being held by a user, and a second head region 5 configured to connect to a brush 3.

The first region 4 encloses a battery 7. The battery 7 may be rechargeable. It should be appreciated that an alternative power source may be used, for example, the device may be connectable to a wall socket of the mains power supply. The battery 7 powers a drive means comprising an oscillation generator 26 and a rotational drive unit located in the second region 5. The oscillation generator 26 is configured to oscillate a shaft 14 disposed in the housing along its longitudinal axis and the rotational drive unit is configured to rotate the shaft 14 about its longitudinal axis. The housing 2 is further provided with an operating switch (not shown) for switching the device on/off and for switching the device into various oscillating and rotating operating modes as explained in more detail below.

Figure 3:
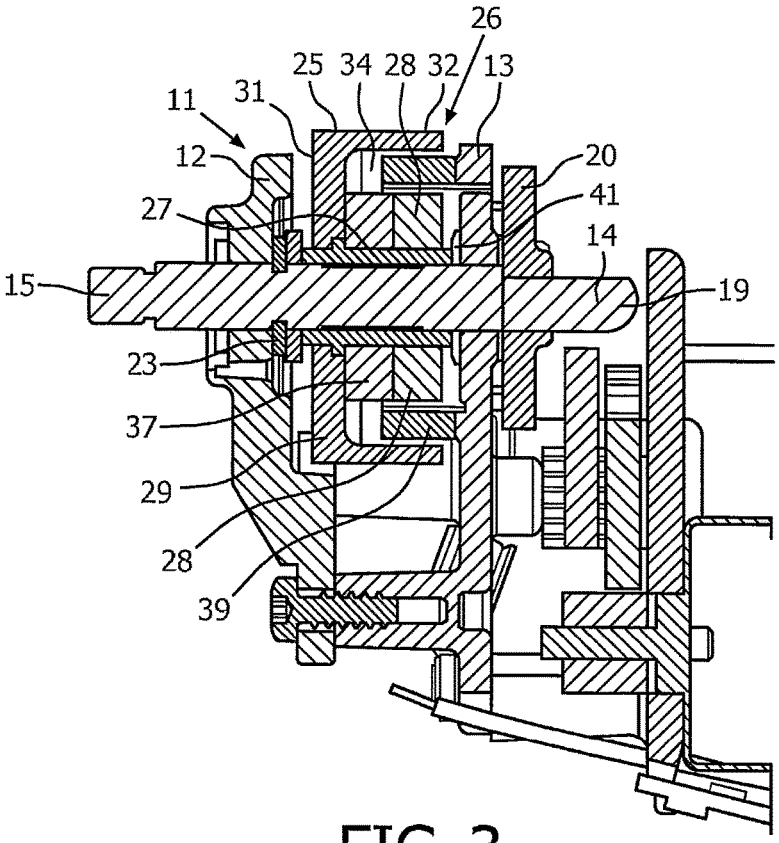
FIG. 3 shows a cross-sectional view of a shaft, an oscillation generator and a train gear.

The shaft 14 is configured to connect to the brush 3 and is disposed in the second region 5 of the housing 2. It is held and supported by a frame 11. The frame 11 is best illustrated in FIG. 3 and it comprises first and second supports referred to as a front and a rear support 12, 13 that are spaced from one another so as to provide room for the oscillation generator 26. The shaft 14 is configured to rotate relative to the front and rear supports 12, 13 as will become apparent from the description below.

Figure 4:
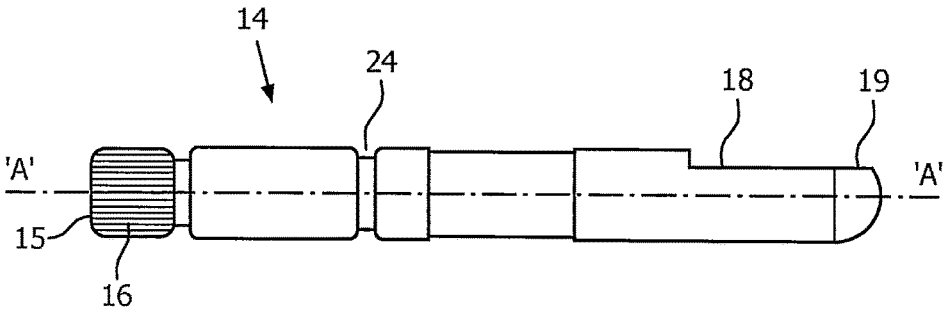
FIG. 4 shows a side view of the shaft shown in FIG. 3.

The shaft 14 is shown in greater detail in FIG. 4, and it is generally shaped as a rod and has a longitudinal axis 'A'. The shaft 14 is preferably made out of stainless steel and comprises a ribbed end 15 which is formed with ridges 16 extending in the longitudinal direction 'A' of the shaft 14. When the shaft is disposed in the housing 2, the ribbed end 15 projects out of the second region 5 of the housing 2 where it connects to a corresponding recess 17 formed in the brush 3 (see FIG. 2). The recess 17 of the brush 3 is formed of plastic and the brush is attached to the ribbed end 15 of the shaft 14 by press fit such that the plastic of the recess cold flows between the ridges 16. The ridges 16 of the ribbed end 15 improve the connection between the brush 3 and the shaft 14 as they mechanically interlock with the recess 17 of the brush 3 in a rotational direction about the longitudinal axis 'A' of the shaft 14. It should be understood that the present invention is not limited to a brush being connected to the housing, as any alternative skin treating part, such as a cotton pad or cushion, can be connected to the ribbed end which has a cleaning, exfoliating or massaging effect.

A seal (not shown) is provided between the shaft 14 and the housing 2 proximal to the ribbed end 15 so as to form a water tight seal between said shaft 14 and housing 2.

Figure 2:
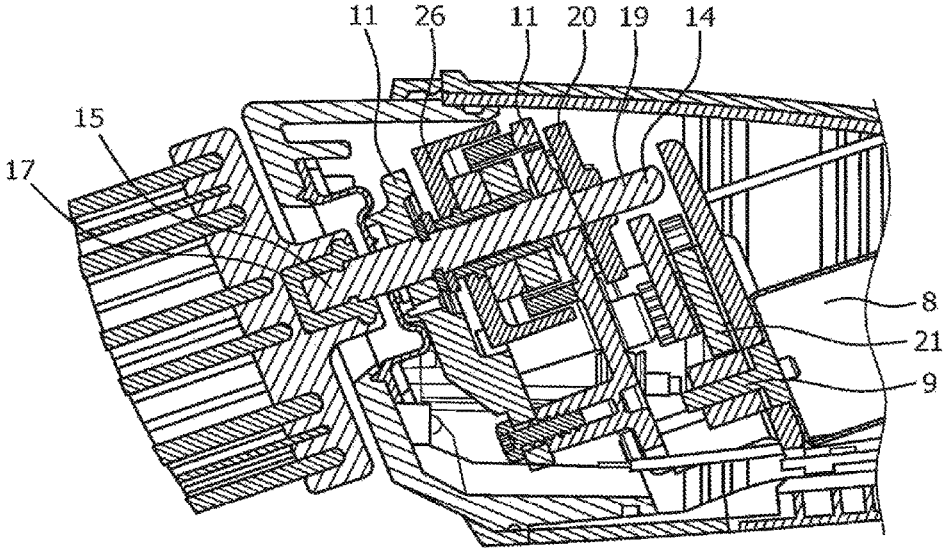
FIG. 2 shows a close-up of the side view of the embodiment shown in FIG. 1.

On an opposite end 19 to the ribbed end 15, the shaft 14 is formed with a cut out portion 18 along the axial direction such that the cross-sectional profile of the shaft transverse to the longitudinal axis is 'D' shaped, as can be appreciated from FIG. 4. This end 19 locates in a corresponding centre of a gear 20 (see FIGS. 2 and 3) which forms part of the rotational drive unit The rotational drive unit comprises a motor 8 which is located in the housing 2 between the first and second regions 4, 5. The motor 8 has a motor shaft 9 as best seen in FIG. 2, the motor shaft 9 can be driven in two opposing rotational directions and at different rotational speeds. The rotational drive unit further comprises a train gear 21 which is connected to the motor shaft 9 of the motor 8. The rotating movement of the rotational drive unit is generated by the motor 8 which rotates the motor shaft 9. The motor shaft 9 in turn rotates the train gear 21 including the gear 20 which the shaft 14 is connected to such that shaft 14 itself rotates. This is not described in any great detail as it is considered to be common general knowledge of a skilled person. It shall be appreciated that the train gear may comprise one or a plurality of gears depending on the arrangement of the motor 8 and the shaft 14.

As described above, the shaft 14 is held by the front and rear supports 12, 13 of the frame 11. The rear support 13 holds the shaft 14 in a region adjacent to the cut out portion 18 such that the shaft can rotate and move in an axial direction relative to said rear support 13. The shaft 14 is moveable in an axial direction relative to the gear 20 in which it locates. The front support 12 is formed with an e-clip 23 (see FIG. 3) which locates in a circumferential groove 24 (see FIG. 4) formed on the shaft proximate to the ribbed end 15 such that the shaft 14 can rotate but is prevented from moving in an axial direction relative to the front support 12. In an alternative un-illustrated embodiment, the front support is not formed with an e-clip and the front support is configured to locate directly in the circumferential groove 24.

The front support 12 is flexibly connected to the frame 11 so as to allow for the shaft to move between a forward and a rearward position as the shaft oscillates along its longitudinal direction.

Located between the front and rear supports 12, 13 of the frame 11, is a flux assembly 25 which forms part of the oscillation generator 26. The flux assembly 25 is formed on a bush 27 which surrounds the shaft 14. The bush 27 and the corresponding bearing surface of the shaft 14 enable the shaft 14 to rotate freely relative to the flux assembly 25.

The flux assembly 25 will now be described with reference to FIGS. 3 and 5.

The flux assembly comprises inner and outer flux concentrators 28, 29, preferably made out of a magnetically soft material such as a soft iron. The outer flux 29 concentrator is formed of a circular base panel 31 having a peripheral side panel 32. The inner flux concentrator 28 is shaped into a disc and although not illustrated, it should be understood that the inner flux concentrator 28 may also be formed with a peripheral side panel. The inner flux concentrator locates within the outer flux concentrator 29 and a concentric annular gap 34 is formed between a peripheral edge 35 of the inner flux concentrator and the peripheral side panel 32 of the outer flux concentrator 29. A space is also formed between a flat surface 36 of the inner flux concentrator 28 and the circular base panel 31 of the outer flux concentrator 29. Both the circular panel 31 of the outer flux concentrator 29 and the inner flux concentrator 28 are formed with a central hole (not shown) through which the shaft 14 extends.

The flux assembly 25 further comprises a permanent magnet 37 located in the space formed between the flat surface 36 of the inner flux concentrator 28 and the circular base panel 31 of the outer flux concentrators 29. The magnet 37 is preferably made out of neodymium iron boron and is also disc shaped formed with a central hole (not shown) such that the shaft 14 can extend therethrough. The magnet 37 has a similar diameter to the inner flux concentrator 28 such that that the annular gap 34 extends also between the magnet 37 and the peripheral side panel 32 of the outer flux concentrators 29.

Figure 5:
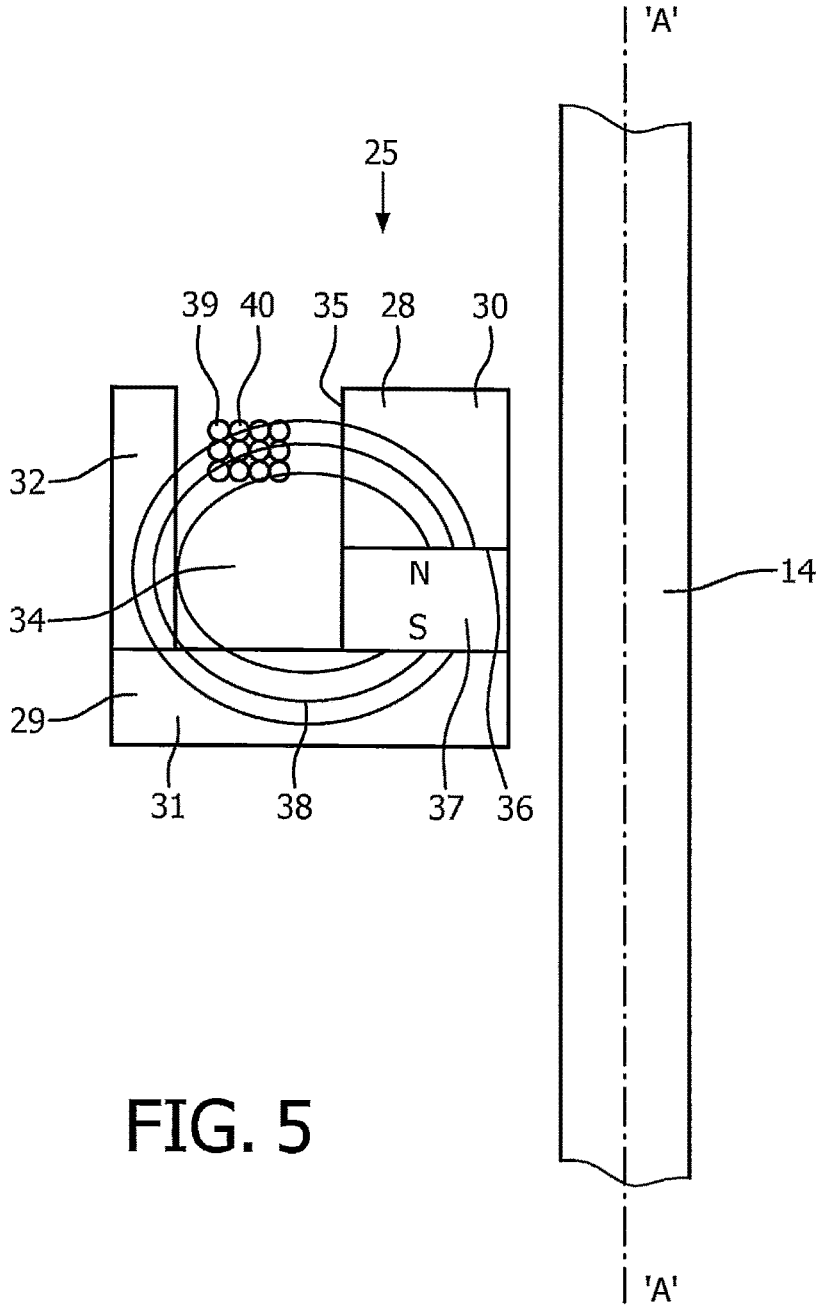
FIG. 5 shows a schematic illustration of a cross-section of half of the oscillation generator shown in FIG. 3.

Referring now to FIG. 5, the polarity of the magnet 37 is permanent and the north and south poles are represented by 'N' and 'S'. The magnetic field 38 emitted by the magnet 37 is illustrated by the lines 30. The magnetic field 38 is substantially radially orientated relative to the longitudinal axis 'A' of the shaft 14 around which the magnet 37 locates, and as the magnet 37 is sandwiched between the inner and outer flux concentrators 28, 29, the majority of the magnetic field 38 emitted by the magnet 37 is contained within the annular gap 34 such that a great magnetic force is generated.

In addition to the flux assembly 25, the oscillation generator 26 further comprises a solenoid 39 is attached to the rear support 13 and is locatable in the annular gap 34. The solenoid 39 comprises numerous turns of insulated conductor wire 40 and is arranged such that it is concentric with the magnet 37 and the flux concentrators 28, 29, however there is no contact between the solenoid 39 and the flux assembly 25. Preferably, the solenoid 39 is made out of copper wire being 0.15 mm in diameter, having a resistance of 10.2R and coiled for 220 turns.

The solenoid 39 is electrically connected to the battery 7 via an inverter (not shown). The inverter converts direct current (dc) supplied by the battery 7 to alternating current (ac). The alternating current flowing through the coiled wire 39 produces a magnetic field having an alternating polarity that interacts with the permanent magnetic field of the magnet 37 sandwiched between the inner and outer flux concentrators 28, 29. As a result of the alternating polarity of the solenoid 39, the magnet 37 and the solenoid 39 are alternating between being attracted and repelled by one another.

As described above, the inner and outer flux concentrators 28, 29 and the magnet 37 are mounted on the bush 27 such that the shaft 17 can freely rotate relative to them. This arrangement also enables the bush 27 and the flux assembly 25 to move in an axial direction 'A'. As the solenoid 39 is attached to the rear support 13 and its polarity is alternating, the bush 27 and the flux assembly 25 is moving towards and away from the solenoid 39 along the shaft 14. This generates a vibrational or an oscillating motion that is transferred to the front support 12 via the e-clip 23 and the rear support 13 via stops 41 as will now be explained.

When an electrical current is passed through the solenoid 39 in a direction which results in a magnetic field to be emitted which repels the flux assembly 25, the flux assembly 25 rapidly moves along the shaft 14 towards the front support 12. The forward movement of the flux assembly is stopped as it impacts the e-clip 23. This generates an axial force which is transmitted to the shaft 14 by the front support 12 flexing forward, thereby causing the shaft 14 to move to a forward position. When the direction of the current in the solenoid 39 is reversed such that the magnetic field emitted changes polarity and thereby attracts the flux assembly, the flux assembly 25 rapidly moves towards the solenoid 39 attached to the rear support 13 and impedes the stops 41 formed on the rear support 13. As a result of this in combination with that the user pushes the brush against the skin, the shaft 14 moves to a rearward position. As the direction of the current is alternating, the flux assembly oscillates or vibrates along the shaft 14 and impacts the e-clip 23 of the front support 12 and the stops 41 on the rear support 13 resulting in the shaft 14 oscillating or vibrating in an axial direction of its longitudinal axis 'A'.

To reduce noise resulting from the flux assembly 25 impacting the e-clip 23 and the stops 41, a spring (not shown), such as a curved spring disc, can be located at either or both ends of the outer flux concentrator 29 impacting the e-clip 23 and stops 41. The springs reduce the momentum of the flux assembly 25 however sufficient force is transferred to the e-clip 23 and stops 41 such that the shaft 14 moves between its forward and rearward positions. The springs are preferably made out of a non-metallic, age-hardening beryllium copper alloy with high strength. The nominal spring has a spring rate of 3.2 N/mm and so the spring rate at 80 Hz frequency is 2.8 N/mm and the spring rate at 110 Hz frequency is 5.3 N/mm.

The device 1 further comprises a frequency converter (not shown) which changes the frequency of the alternating current so that the resulting oscillation of the flux assembly 25 can be changed. In a preferred embodiment, the frequency converter is configured to convert the frequency between two modes; the first mode being 80 Hz and the second mode being 110 Hz. A higher frequency produces less audible noise than a lower frequency mode because the directional change of the flux assembly is faster which prevents the flux assembly from impacting the e-clip 23 and the stops 41 with such a high momentum compared to a lower frequency.

The fact that the components of the oscillation generator 26 are not mechanically connected to the shaft 14, results in the oscillating movement being independently controlled relative to the rotating movement. Therefore, the device 1 can be configured to operate at various modes. For example, the operating switch might have eight settings corresponding to eight operating modes which are based on three rotational speeds; 0, 180 and 250 rpm, and three oscillating frequencies; 0, 80 and 110 Hz. The combinations of modes are listed in the table below.

| Operating mode | Rotation in rpm | Oscillation in Hz |
|---|---|---|
| 1 | 180 | 80 |
| 2 | 250 | 110 |
| 3 | 180 | 0 |
| 4 | 250 | 0 |
| 5 | 0 | 80 |
| 6 | 0 | 110 |
| 7 | 180 | 110 |
| 8 | 250 | 80 |

The device further comprises a controller (not shown) which is configured to control the different operating modes in response to a user input. For example, when a user switches the switch into a first setting so that the device is in its first operating mode, the controller operates the battery 7 so that it supplies current to the motor 8, and operates the motor 8 so that the shaft 14 and the brush 3 rotates at 180 rpm. Simultaneously, the controller operates the battery 7 so that it supplies current to the oscillation generator 26. The controller further operates the inverter so to convert the direct current to an alternating current. The controller also sets the frequency converter to 80 Hz. As a result, the oscillation generator 26 also oscillates the shaft 14 and the brush 3 in the axial direction at 80 Hz.

If a user thereafter changes the operating mode to operating mode 5 by pressing or moving the switch, the controller switches off the supply of current from the battery 7 to the motor 8 but continues to operate the oscillation generator 26 such that the shaft 14 and brush 3 only move in the axial direction. If the user thereafter changes the operating mode to operating mode 6, then the controller operates the frequency converter so that it increases the frequency of the alternating current resulting in a stronger oscillation of the shaft 14.

It should be understood that the device is not limited to these eight operating modes. The device may comprise more or fewer oscillating frequencies and/or rotational speeds, such that it comprises more or fewer operating modes.

In an alternative un-illustrated embodiment, the device comprises two separate switches, a first switch for controlling the rotation of the shaft 14 and the brush 3 and a second switch for controlling the oscillation of the shaft 14 and the brush 3. The first switch may have four settings corresponding to four rotational speeds; 0, 180, 220 and 250 rpm, and the second switch may also have four setting corresponding to four oscillating frequencies; 0, 80, 100 and 110 Hz. Thus, the device is configured to have a total of 15 operating modes. Advantageously, the user can operate the two switches independently of one another so that they can obtain the desired combination of rotating and oscillating movement of the brush 3. It should be understood that the two separate switches are not limited to having four settings each, for example, each switch may be configured to have three settings each such that the device has a total of eight operating modes.

When the device 1 is operated in an oscillating mode, the shaft 14 and also the brush 3 oscillate or move in a direction parallel to the longitudinal axis 'A' of the shaft 14. Thus, when the device is being used, the brush 3 and the shaft 14 oscillate or move substantially perpendicular to the skin, which improves the cleaning and the massaging effect on the skin.

Advantageously, the configuration of the device as described above enables the oscillating movement and rotating movement to be independently adjusted to the user's preference.

It should be understood that the device 1 is not limited to comprising a brush 3, it may comprise an alternative skin treating part having a rough surface for exfoliating or a surface comprising massaging protrusions.

In an alternative un-illustrated embodiment, the oscillating generator 26 is reversely configured such that the solenoid 39 is mounted on the front support 12 and the shaft 14 is formed with a groove in which the rear support 13 locates.

In yet another embodiment, both the front and the rear supports 12, 13 are flexibly connected to the frame 11 and the shaft 14 is formed with a second circumferential groove in which the rear frame 13 locates such that impact of the oscillation generator and the front and rear supports 12, 13 oscillate or move the shaft 14 in an axial direction between forward and rear positions.

It shall also be understood, that the inner and outer flux concentrators 28, 29, the permanent magnet 37 and the solenoid 39 are not limited to having a circular cross-section transverse to the longitudinal axis of the shaft. For example, they can all have a square or a rectangular cross-section.

It will be appreciated that the term "comprising" does not exclude other elements or steps and that the indefinite article "a" or "an" does not exclude a plurality. A single processor may fulfil the functions of several items recited in the claims. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A device for treating skin comprising:

a housing;

a shaft located in the housing having a longitudinal axis 'A' and an end for receiving a skin treating part; and a drive means coupled to the shaft for (i) rotating the shaft about its longitudinal axis, and (ii) oscillating the shaft in a direction along the longitudinal axis, wherein the drive means comprises (i) a rotational drive unit that includes a motor having a motor shaft rotatably coupled to a gear that is mounted to a cut-out portion of the shaft and configured to rotate the shaft about the longitudinal axis and (ii) an oscillation generator configured to oscillate the shaft, via a transfer of axial force through at least one support member to the shaft, along the longitudinal axis, wherein the oscillation generator is located about the shaft and configured to enable the shaft to rotate relative to the oscillation generator, further wherein the oscillation generator comprises (i) a solenoid and (ii) a flux assembly that includes at least a flux concentrator and magnet, wherein the flux assembly is moveable along the longitudinal axis of the shaft, via a bushing about the shaft, relative to the solenoid.

2. The device according to claim 1, wherein the rotational drive unit and the oscillation generator are configured such that the speed of the rotation and the frequency of the oscillation of the shaft can be independently changed of one another in response to a user input.

3. The device according to claim 1, wherein the flux concentrator comprises an inner flux concentrator and an outer flux concentrator, and said magnet is located therebetween.

4. The device according to claim 3, wherein the outer flux concentrator comprises a base panel having a peripheral side panel, and wherein the inner flux concentrator is received within an inner region defined by the peripheral side panel, wherein the magnet is located between the inner flux concentrator and the base panel, and wherein a gap is formed between the inner flux concentrator and the peripheral side panel for receiving the solenoid.

5. The device according to claim 1, wherein the at least one support member further comprises a first support and a second support, wherein the first and second supports are configured to hold the shaft, wherein the flux assembly is located about the shaft between the first and second supports, and wherein the solenoid is attached to one of the first support or the second support.

6. The device according to claim 5, wherein the first and second supports are configured to hold the shaft such that the shaft is (i) rotatable, via the rotational drive unit, relative to the first and second supports about the longitudinal axis and (ii) prevented from moving along the longitudinal axis relative to at least one of the first support or the second support.

7. The device according to claim 6, wherein the shaft includes a circumferential groove adapted to locate one of the first or second supports with respect to the shaft so as to prevent the shaft from moving along the longitudinal axis relative to the support that is located via the circumferential groove, and wherein the support that is located via the circumferential groove is flexibly connected to a frame of the device.

8. The device according to claim 7, wherein the support that is located via the circumferential groove includes an e-clip that is located in the circumferential groove.

9. The device according to claim 5, wherein one of the first support or the second support includes a stop, wherein the flux assembly impacts the stop as the flux assembly oscillates between a forward position and a rearward position along the direction of the longitudinal axis.

10. The device according to claim 5, further comprising a spring located between (i) one of the first support or the second support and (ii) the flux assembly, wherein the spring is configured to reduce an impact between (i) the first support or second support and (ii) the flux assembly as the flux assembly oscillates between a forward position and a rearward position along the direction of the longitudinal axis.

11. The device according to claim 1, further comprising a power source configured to power the drive means.

12. The device according to claim 11, further comprising an inverter configured to change a direct current supplied by the power source to an alternating current.

13. The device according to claim 12, further comprising a frequency converter configured to change a frequency of the alternating current.

* * * * *